United States Patent [19]

Iizaka et al.

[11] 4,056,390

[45] Nov. 1, 1977

[54] PROCESS FOR TRANSFERRING ELECTROSTATIC LATENT IMAGES

[75] Inventors: Isao Iizaka; Toshio Yamamoto, both of Toyokawa, Japan

[73] Assignee: Minolta Camera Kabushiki Kaisha, Osaka, Japan

[21] Appl. No.: 614,387

[22] Filed: Sept. 18, 1975

Related U.S. Application Data

[60] Continuation-in-part of Ser. No. 452,861, March 20, 1974, abandoned, which is a division of Ser. No. 330,722, Feb. 8, 1973, Pat. No. 3,824,012.

[30] Foreign Application Priority Data

Feb. 17, 1972 Japan ..... 47-16816
Feb. 21, 1972 Japan ..... 47-21364

[51] Int. Cl.[2] ..... G03G 13/22

[52] U.S. Cl. ..... 96/1 TE; 355/3 R; 355/16

[58] Field of Search ..... 96/1 TE; 355/3 R, 16

[56] References Cited

U.S. PATENT DOCUMENTS

| | | | |
|---|---|---|---|
| 3,121,873 | 2/1964 | McNaney | 96/1 TE |
| 3,147,679 | 9/1964 | Schaffert | 96/1 TE |
| 3,240,596 | 3/1966 | Medley et al. | 96/1 TE |
| 3,281,857 | 10/1966 | Kaiser | 96/1 TE |
| 3,666,458 | 5/1972 | Arneth et al. | 96/1.5 |

FOREIGN PATENT DOCUMENTS

| | | |
|---|---|---|
| 4,219,757 | 10/1967 | Japan. |

*Primary Examiner*—Roland E. Martin, Jr.
*Attorney, Agent, or Firm*—Wolder & Gross

[57] ABSTRACT

A dielectric layer of copy paper is brought into contact with an electrostatic latent image bearing surface of a photosensitive plate by a first roller having an electric resistance value substantially higher than the rear face resistance value of the copy paper, the photosensitive plate having on its front face a dielectric layer for forming the latent image thereon and driven by a grounded roller. An electrically conductive lining element of the copy paper is substantially grounded by an electrically conductive second roller to transfer the electrostatic latent image by air breakdown discharge under the influence of the first and second rollers. The gap between the photosensitive plate and the copy paper has a width for air breakdown discharge according to Paschen's law.

10 Claims, 21 Drawing Figures

PROCESS FOR TRANSFERRING ELECTROSTATIC LATENT IMAGES

REFERENCE TO RELATED APPLICATIONS

The present application is a continuation-in-part of application Ser. No. 452,861 filed Mar. 20, 1974, now abandoned, which in turn is a division of application Ser. No. 330,772 filed Feb. 8, 1973, now U.S. Pat. No. 3,824,012.

BACKGROUND OF THE INVENTION

The present invention relates to a process and an apparatus for transfering electrostatic latent images in electrophotography, more particularly for transferring electrostatic latent images formed on a photosensitive plate, one dielectric element, to copy paper, another dielectric element, free of damage to the images to obtain clear and sharp copies.

For the transfer of electrostatic latent image, a photosensitive plate is generally used which comprises an electrically conductive base sheet in the form of a drum or belt and a dielectric layer formed on the base sheet and made up of a single photosensitive layer of amorphous selenium, zinc oxide, organic semi-conductor, or the like, or of a composite photosensitive layer composed of single layers of such materials. The process of transferring an electrostatic latent image includes the step of forming a latent image on the surface of the photosensitive plate by exposing the surface to light reflected from or passing through an original after the surface has been charged by corona discharge or the like, and the step of bringing copy paper into intimate contact with the photosensitive plate by an electrically conductive roller made of conductive rubber, metal or the like, to transfer the latent image to the copy paper, the copy paper having on its front face a dielectric layer of a high electric resistance (at least $10^{12}$ ohms) and on its rear face an electrically conductive layer of a high resistance ($10^5$ to $10^{10}$ ohms).

If the copy paper is brought into intimate contact with the photosensitive plate by one grounded roller during the transfer process described, a larger electric energy gap will be produced between the photosensitive plate bearing the electrostatic latent image at a high potential (at least 1000 volts) and the copy paper at nearly zero potential when there exists a relatively large gap therebetween before they come into intimate contact with each other, with the result that abnormal discharge will take place, partially damaging the latent image. Thus it is very difficult to transfer the latent image to the copy paper free of damage, and objections will result such an non-developed spots in the developed image on the copy.

To eliminate such drawback, processes have been proposed as disclosed for example in U.S. Pat. No. 3,147,679 by R. M. Schaffert and Publication of Japanese patent application No. 19757/1967 by Shaffert et al.

The process of U.S. Pat. No. 3,147,679 is schematically shown in FIG. 1 in which an electrostatic latent image is formed by well known means on a photosensitive plate 4 on the surface of a grounded drum, and copy paper 3 is brought into intimate contact with the latent image bearing surface by a first roller 1 provided with a voltage of the same polarity as the charge on the image bearing surface. Subsequently, the latent image is transferred by a second roller 2 applied by a potential source 7 with a high voltage of polarity opposite to that of the charge of the latent image. A charger 6 previously places a potential of polarity opposite to that of the latent image on the dielectric layer of the copy paper 3, so that in order to prevent abnormal dishcharge between the photosensitive plate 4 and the copy paper 3 immediately before the aforementioned intimate contact is achieved by the first roller 1, there is provided a variable potential source 5 capable of supplying from zero to a relatively high potential of several thousand volts to the first roller 1. The variable potential source 5 further applies to a separating roller 8 a voltage of the same polarity as the roller 1 to prevent damage due to discharge when the copy paper 3 is separated. Thus the disclosed process requires the variable potential source 5 which is very complex and large. Furthermore, since transfer is effected through field emission, the gap between the photosensitive plate 4 and the copy paper 3 must be kept very small, for instance, not greater than 10 microns. The coarseness of the surface of the copy paper 3 therefore exerts a serious influence on the transfer effect, and the copy paper must be highly smooth surfaced, hence limitation on the quality of the copy paper. The application of a high voltage on the second roller further requires sufficient care to assure safety.

The process of Publication of Japanese Patent Application No. 19757/1967, an improvement over the process illustrated in FIG. 1, is schematically shown in FIG. 2. According to this process, there is provided a first roller 1 for bringing copy paper 3 into contact with a photosensitive plate 4' with an electrostatic latent image formed on its dielectric surface by known means, before the paper 3 reaches a grounded electrically conductive roller (second roller) 2'. A variable potential source 5 applies to the roller 1 a potential of the same polarity as the surface charge of the photosensitive plate 4' to prevent abnormal discharge before the paper is brought into intimate contact with the plate and to thereby eliminate damage to the transferred latent image. A drive roller 9 for the photosensitive plate 4' is grounded.

This process has overcome the drawback of the process of FIG. 1 that a high voltage must be applied to the second roller, but it is still necessary to use the complex and large variable potential source 5 for the first roller 1 as in the case of FIG. 1. Instead of applying a high voltage to the second roler 2', the second roller 2' is merely grounded and is subjected to a high pressure, for example of 21 kg/cm$^2$ (about 300 lb/in$^2$) to control the gap between the photosensitive plate 4' and the paper 3 to a very small width (for example not greater than 3 microns) such that the air will be expelled from the gap. Accordingly, the second roller must be provided with pressure means 10 which is complex, with further consideration given to render the operation means strong enough to withstand the high pressure. It is also necessary to use very smooth surfaced transfer paper.

The process of FIG. 1 involves latent image transfer which utilized air breakdown discharge across a small gap of not greater than 10 microns between the photosensitive plate and copy paper with the application of high voltage, in combination with latent image transfer by field emission at a smaller gap, whereas the process of FIG. 2 is a latent image transfer process by field emission at a very small gap (for example not greater than 3 microns). Either process requires an extremely high degree of smoothness for the contact surfaces of both copy paper and photosensitive plate as well as a complex and large mechanism which is resistant to pressure and voltage.

SUMMARY OF THE INVENTION

An object of this invention is to provide a process for transferring latent images which utilizes air breakdown discharge across a gap between a photosensitive plate and copy paper relatively greater than in the known processes described and which gives transferred images free of damage.

Another object of this invention is to provide a process which permits the use of copy paper with surface smoothness in an enlarged permissible range and which is capable of giving copy images sufficiently satisfactory for office uses.

Another object of this invention is to provide a simple appratus for contolling air breakdown discharge in the course of approach of copy paper to the photosensitive plate for the image transfer so as to transfer images free of damage.

Still another object of this invention is to provide an apparatus assuring high safety which does not require a complex and large device for applying voltage to a first roller for bringing the copy paper into proximity to the photosensitive paper or for applying a high voltage or high pressure to a second roller for completing the transfer of latent images.

According to this invention, copy paper for receiving an electrostatic latent image formed on the dielectric surface layer of a photosensitive plate by known means is brought into contact with the surface of the photosensitive plate by a first roller to travel with the plate, the first roller being substantially a high resistance element which is electrically ungrounded or grounded by way of a resistor having at least a higher resistance value than a highly resistant electrically conductive layer of the copy paper. No voltage is applied to the first roller from a special external potential source.

As the surface of the copy paper approaches the surface of the photosensitive plate, air breakdown discharge will be initiated against the insulation of the air interposed between the paper and the plate. However, since the first roller is substantially a high resistance element, the air breakdown discharge is not virtually initiated before the gap width reaches 70 to 80 microns. The copy paper is further brought closer to the photosensitive plate by the first roller and a grounded conductive second roller for completing the transfer until the gap width reduces to about 20 microns, while permitting the transfer to proceed. There is no need to reduce the gap width to as small as 10 microns or less and pressure means, even if employed for such purpose, will not result in any benefit in this invention.

The copy paper brought into contact with the photosensitive surface and travelling with the photosensitive plate reaches the position of the grounded conductive second roller and is peeled off the photosensitive surface upon passing over the second roller.

The conductive second roller is grounded by suitable means. The paper brought close to the photosensitive surface by the first roller retains a substantially high potential on its dielectric layer inasmuch as the first roller has a substantially high resistance, without permitting air breakdown discharge to take place while the gap therebetween is relatively wide (for example greater than 70 to 80 microns) in the course of approach of the paper to the photosensitive plate, hence no transfer of the latent image. As the gap reduces, the transfer is initiated at a high potential portion of the electrostatic latent image within the range governed by the resistance value of the first roller. The transfer proceeds progressively at lower potential portions of the latent image since the conductive second roller is grounded and is completed upon the paper reaching the conductive second roller. When the paper has reached the second roller, the paper is conceivably at zero potential due to the grounding. In this way the transfer proceeds while the copy paper on the photosensitive plate travels therewith from the first roller to the conductive second roller and is completed upon the paper reachhing the position of the conductive second roller.

No charge transfer takes place during the separation of the paper from the surface of the photosensitive plate after the paper has passed over the conductive second roller.

It is essential according to this invention that no voltage be applied from an external potential source to the first roller which brings the copy paper into contact with the photosensitive plate. The first roller is substantially a high resistance element, and the transfer of the electrostatic latent image is initiated after the gap between the photosensitive plate and copy paper has reduced to a relatively small width. In fact, the transfer proceeds and is completed across the gap of the order of 20 microns without applying a high pressure to the paper and without injecting a high voltage into the conductive second roller, consequently producing copy images with a high degree of resolution which assures satisfactory use for practical purposes.

The apparatus of this invention for transferring an electrostatic latent image formed on a photosensitive plate to the dielectric layer of copy paper without permitting abnormal discharge to take place comprises a drive member supporting the photosensitive plate to drive the same at a constant speed and substantially grounding the electrically conductive base sheet of the photosensitive plate, a first roller supporting a high resistance electrically conductive layer of the copy paper to guide the paper into contact with the photosensitive plate, the first roller having a higher resistance value than the conductive layer of the copy paper, and a conductive second roller substantially grounding the conductive layer of the copy paper travelling in contact with the photosensitive plate.

In another embodiment of the apparatus of the present invention, the same operational effects can be obtained by using a guide member in the form, for example, of a sheet consisting of a high resistance body in place of the first roller with the remaining structure unchanged. Specifically, the high resistance insulating guide member supports the high resistance conductive layer of copy paper and guides the paper into contact with the photsensitive plate. The copy paper is then carried between the electrically earthed conductive roller and the photosensitive plate, and the transfer of an electrostatic latent image is completed.

Other objects and features of the present invention will become apparent from the following description.

DESCRIPTION OF THE PREFERRED EMBODIMENTS

Figure 1:
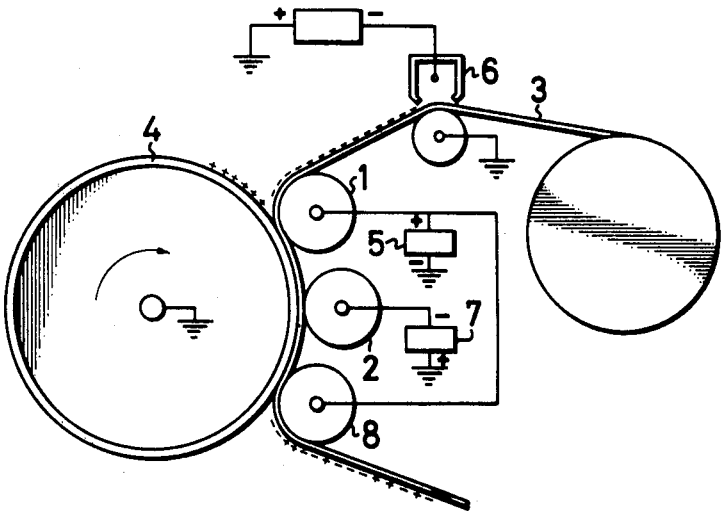
Fig. 1 PRIOR ART
FIG. 1 is a schematic diagram showing a known apparatus for transferring electrostatic latent images by applying a high voltage.
Figure 2:
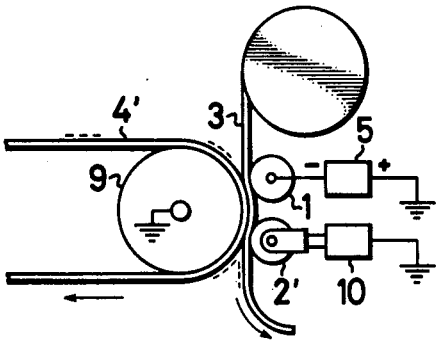
Fig. 2 PRIOR ART
FIG. 2 is a schematic diagram showing another known apparatus for transferring electrostatic latent images by applying a high pressure to a transfer roller.
Figure 3:
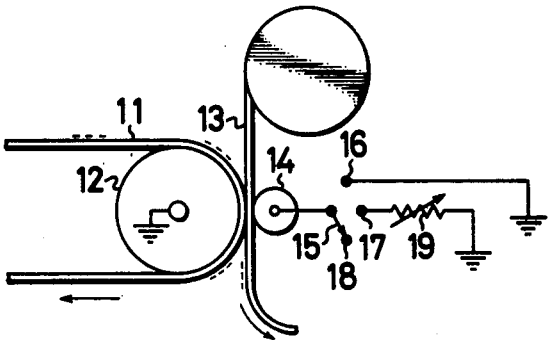
FIG. 3 is a schematic diagram illustrating the principle of the operation of the present invention.

FIG. 3 is a view for illustrating the principle of operation of this invention, in which there is shown a photosensitive plate 11 in the form of a belt which is supported on a grounded conductive roller 12 and is driven as indicated by the arrow in the drawing. The photosensitive plate 11 is not limited to the belt form, but may be in the form of a drum as well known. During the travel of the photosensitive sheet 11, the dielectric layer in its surface is charged for instance negatively by corona discharge, and the image of an original is then projected onto the layer at an exposure station to form an electrostatic latent image.

Copy paper 13 paid out from a roll has its dielectric layer brought into intimate contact with the electrostatic latent image bearing surface of the photosensitive plate 11 by a conductive roller 14 for the transfer of the latent image while being driven along with the photosensitive plate 11.

The conductive roller 14 is electrically insulated from its support means and is selectively connectable to a contact 16, 17 or 18 through a change over contact member 15. The contact 16 is directly grounded, while the contact 17 is grounded by way of a variable resistor 19 having high resistance. The contact 18 is not grounded electrically.

Figure 4:
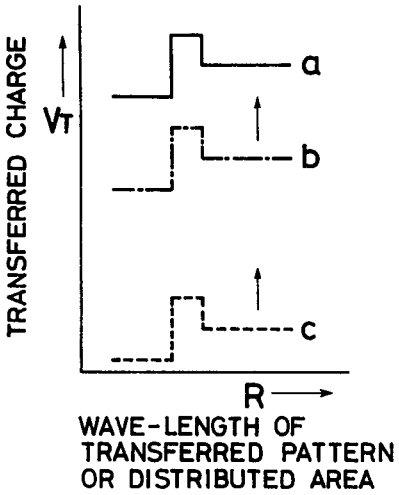
FIG. 4 is a diagram showing transferred charge patterns based on FIG. 3.

Experiments of the transfer of latent image were conducted on the illustrated apparatus by connecting the conductive roller 14 to the contacts 16, 17 and 18 through the change over contact member 15. The results are shown in FIG. 4 in which the transferred charge $V_T$ is plotted as ordinate vs. the wave length of transferred pattern or distributed area R as abscissa. When the roller 14 was connected to the contact 18 and therefore ungrounded, the roller 14 substantially served as a highly insulated roller and the contact of the copy paper 13 with the photosensitive plate 11 gave a very small amount of transferred charge as indicated by the broken line *c* in FIG. 4.

When the roller 14 was connected to the contact 17, a slightly greater amount of charge than in the previous case was transferred as indicated by the dot-dash line *b* due to the presence of the variable resistor 19, whereas if the roller 14 was connected to the contact 16 to ground the roller 14 directly, the transferred charge indicated by the solid line *a* was much more than *b* and *c*, hence efficient charge transfer.

Although the amount of the transferred charge is very great in the case of *a*, a great amount of charge is injected at a time into the roller 14 by grounding, promoting abnormal discharge between the copy paper 13 having hardly any potential and the latent image bearing surface of the photosensitive plate 11 having a high potential, and the result will be departure from the object of this invention.

If the roller 14 is grounded by way of the variable resistor 19 through the contact 17, it is possible to progressively increase the transferred charge from *b* and *a* of FIG. 4, by controlling the resistor 19. When the result is visualized on copy paper by electrophotographic wet developing method, it has been found that as the amount of transferred charge increases from *c* to *b* then to *a*, the density of the developed image obtained increases, whereas nondeveloped spots also increases and spread in the black portion of the image due to damage to the latent image. However, if the roller 14 is connected to the contact 18 out of contact with the ground, the developed image is completely free of nondeveloped spots, in other words, the latent image is free of any damage although the developed image has a low density.

Further explanation will be given with reference to the graph of FIG. 5 according to Paschen's law generally cited for the transfer of electrostatic images, in which break down voltage $V_g$ across the air gap between the photosensitive plate 1 and transfer paper 13 is plotted as ordinate vs. the width *d* of the air gap as abscissa. Acutal discharge takes place at the points of intersection $P_1$, $P_2$, $P_3$, $P_{2'}$, and $P_{1'}$, of the Paschen curve P and the curves $V_S$ of surface potential of the photosensitive plate.

Suppose the roller 14 is connected to the contact 16 and a copy sheet is progressively brought closer to a photosensitive plate having a surface potential of $V_S$ for the transfer, i.e., for the above mentioned discharge, the curve $V_S$ intersects the curve P at $P_1$ when the distance (i.e. gap width) *d* between the two sheets reaches $d_1$ in the vicinity of the transfer portion of the roller 14 and discharge takes place, whereupon $V_S$ reduces to $V_{S1}$. As the copy paper is further brought closer, intersection $P_2$ takes place at $d_2$ for discharge. With further approach, the resulting potential $V_{S2}$ has a point of intersection $P_3$ at $d_3$ for discharge. When consequently lowered to $V_{S3}$, the potential no longer intersects P in spite of further approach and no discharge will take place, namely no transfer.

Figure 5:
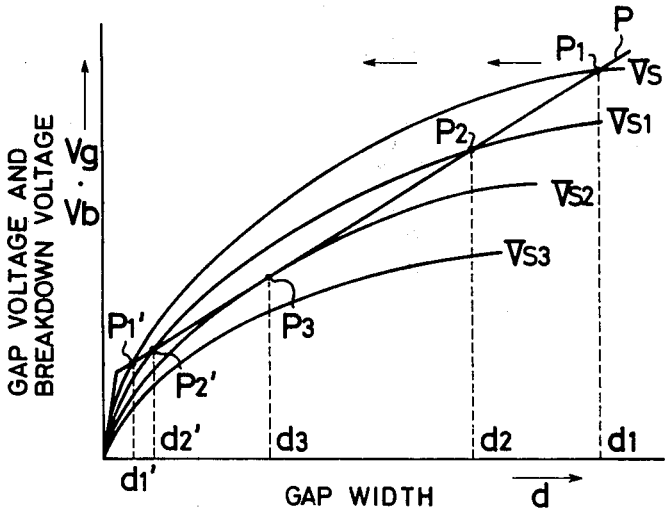
Fig. 5 PRIOR ART
FIG. 5 is a graph of critical value for transfer based of Paschen's law.

Although FIG. 5 presents a few curves $V_S$ for illustration, a great number of curves $V_S$ can be plotted actually, and as the gap width $d$ reduces, discharge occurs theoretically almost continuously for transfer.

If the roller 14 is connected to the contact 17, there is less injection of charge in the vicinity of transfer portion of the roller 14 because of the resistor 19, with the result that the potential relative to the copy paper approaches the potential of the photosensitive plate, with the potential difference therebetween reduced. Thus the apparent surface potential of the photosensitive plate relative to the copy paper reduces to $V_{S1}$. The curve therefore has a point of intersection $P_2$ at the distance $d_2$ therebetween for the initiation of discharge. Further if the roller is connected to the contact 18, namely, if the roller is electrically ungrounded, no charge will be injected into the transfer roller, namely into the copy paper. Theoretically, therefore, the potential of the copy paper nearly equals that of the photosensitive plate and there will be no discharge, hence no transfer. However, since the copy paper is virtually subjected to leak charge, a small amount of charge will be transferred to the copy paper, permitting discharge to take place at a point of intersection $P_3$ of P and $V_{S2}$ *in FIG. 5.*

Among the three transfer methods described, the method in which the roller 14 is grounded by way of the variable resistor 19 permits the roller 14 to be automatically applied with a variable voltage, and the gap of electrical energy produced in the space between the photosensitive paper 11 and copy paper 13 upon the initiation of discharge becomes smaller than in the case where the roller 14 is directly grounded. Thus discharge will occur across a smaller gap between both elements when they are brought together closer, making it more difficult for abnormal discharge to take place. If the roller 14 is electrically ungrounded, the voltage energy gap further reduces, permitting no abnormal discharge. In this state, there is a very small gap (conceivably, of the order of 20 microns to 70–80 microns theoretically) between the photosensitive plate 11 and copy paper 13, permitting continuous air breakdown discharge to take place. However, since the copy paper 13 will hardly be charged from outside in this state, the amount of transferred charge will reduce. Thus in the case where no abnormal discharge occurs, the transferred charge decreases to lower the density of developed image, failing to achieve the object to obtain an image of good quality. It is impossible to overcome such difficulty with only one roller. However, it has been found that the intended object can be accomplished by providing a first roller serving to prevent abnormal discharge and a second electrically conductive roller for increasing the amount of transferred charge.

A more detailed explanation will be given with reference to FIG. 6. A photosensitive plate 20 in the form of a belt comprises a dielectric layer 21 and an electrically conductive element 22 lining the layer 21, and is driven on electrically conductive rollers 23 and 24 in the direction of the arrows in the drawing. The rollers 23 and 24 are grounded.

Copy paper 25 comprises a dielectric layer 26 lined with an electrically conductive element 27 and guided by electrically conductive rollers 28 and 29. The dielectric layer 26 is positioned close to the dielectric layer 21 of the photosensitive plate 20 with a gap interposed therebetween. The paper is driven in the direction of the arrow at a speed equal to that of the photosensitive plate 20.

The rollers 28 and 29 are located at the opposite ends of the area where the photosensitive plate 20 and the transfer paper 25 are located close to each other, in opposing relation to the rollers 23 and 24 supporting the photosensitive plate 20. The first and second rollers 28 and 29 are both grounded, the first roller 28 being grounded by way of a variable resistance element 30 having high resistance.

Electrostatic latent images are formed on the surface of the dielectric layer 21 by known means. It is herein assumed that the latent image is negatively charged in accordance with the nature of the photosensitive plate.

With this apparatus, it is critical that the first roller 28 is simply grounded by way of the high resistance element 30, free of application of voltage from a special external power source.

In the construction described, the photosensitive plate 20 and copy paper 25 are driven. When the copy paper 25 is first fed between the photosensitive plate 20 and the first roller 28, the dielectric layer 26 is brought closer to the latent image on the photosensitive plate 20 (step 1), subsequently sent forward from the position immediately above the first roller 28 to the position immediately above the second roller 29 while being spaced apart from the plate 20 by a definite small gap (step 2) and is thereafter moved away from the plate 20 progressively (step 3).

In this construction, no voltage is applied to the two rollers 28 and 29 from an external voltage source, and discharge, namely the transfer of latent image is effected during the steps 1 and 2. Due to the presence of the high resistance element 30 for the first roller 28, discharge is initiated at a relatively reduced gap.

More specifically, as the electrostatic latent image formed on the phososensitive plate 20 is brought closer to the copy paper 25 which is in contact with the first roller 28 (step 1), induction gives an increasing potential to the first roller 28. Since the first roller is grounded through the high resistance element 30 having resistance of at least $10^7$ ohms, the roller has a higher potential in corresponding relation to the resistance value than when the roller is directly grounded. Because the potential of a portion H (indicated by hatching) of the copy paper 25 around which it is in contact with the first roller 28 approaches the potential of the photosensitive plate, the gap potential difference $V_g$ reduces to initiate discharge, namely transfer at gap $d$ (this being more accurately associated with line P in FIG. 5).

The discharge reduces the surface potential of the photosensitive plate and increases the potential of the transfer paper to decrease the gap potential difference. By virtue of further approach of the paper to the plate, the discharge is sustained. The first roller 28 will be interpreted to effect image transfer until the gap reduces to a minimum value immediately above the first roller 28. The higher the surface potential of the electrostatic latent image, the higher will be the transfer suppressing action which reduces the gap potential difference, hence convenient for the prevention of abnormal discharge.

The first step of transfer is effected by the approach method as described. With reference to FIG. 5, further explanation will be given. Suppose that the surface potential $V_s$ reduces to an apparent value of $V_{sl}$ as already described as to the reduction of the gap potential difference $V_g$ under the action of the first roller 28, the discharge is initiated when the gap $d_1$ is reduced to $d_2$ and is completed upon the gap reaching $d_3$. This indicates that the transfer by the approach method can be effected at a relatively small gap, with the outstanding effect of being free of substantial reduction in resolution and assuring trouble free operation in practice.

In this way, the transfer of step 1 is effected only at a high potential portion of the latent image by the first roller 28, and the copy paper 25 leaves the area under the control of the first roller 28. This will be explained with reference to FIG. 7 (P), in which the hatched portion of the latent image Z represents the entire charge to be transferred, K representing the critical value for transfer below which the transfer does not take place. By the first transfer operation by the first roller 28, part of the latent image is transferred which corresponds to the charge $T_H$ represented by the hatched portion of FIG. 7 (Q), namely to the high potential portion of the surface charge.

As already described, charge transfer effected without applying voltage to the first and second rollers from an external power source is conducted by the three methods of:

a. direct grounding
b. grounding through a resistor
c. without grounding

Figure 6:
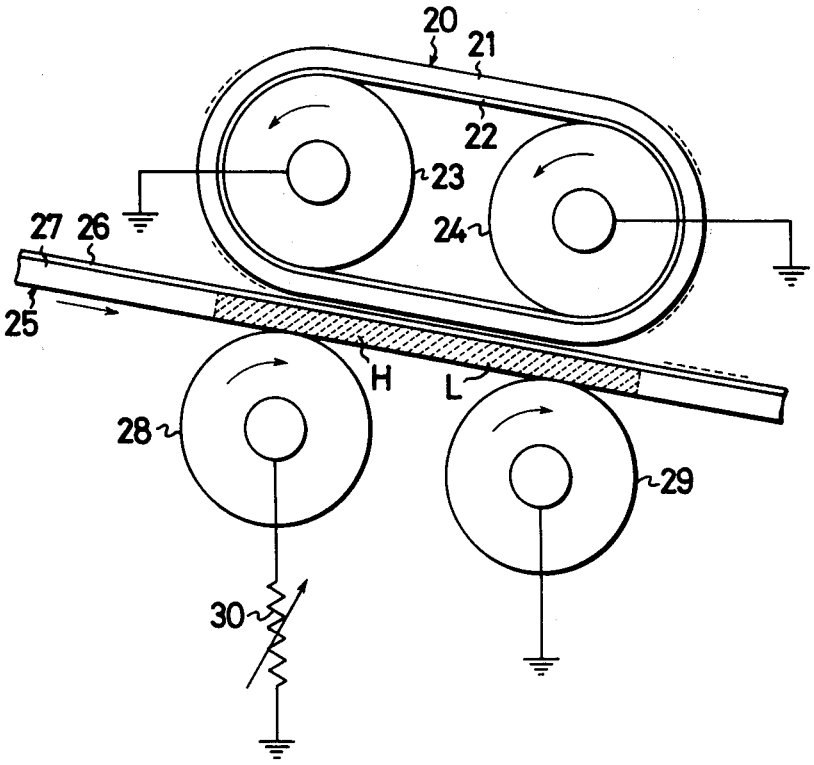
FIG. 6 is a schematic diagram illustrating a transfer operation by an embodiment of the present invention.

The first roller 28 of FIG. 6 represents the case (*b*) above. If the surface potential of the latent image is constant in these cases, the potential of the roller 28 which elevates due to induction is lowest in the case of (*a*) and increases in the order of (*b*) and (*c*). Thus in accordance with the difference in the gap voltage relative to the surface potential, the transferred charge is conceivably greatest in the case of (*a*) and decreases in the order of (*b*) and (*c*). However, since the latent image will virtually be damaged at a portion where the gap voltage is high, the case (*a*) does not necessarily achieve the best result, whereas the amount of transferred charge in the case of (*c*) is too small.

Subsequently, the latent image bearing portion which has passed over the first roller 28 advances toward the electrically conductive second roller 29 which is grounded (step 2). At this time, the potential of the copy paper 25 relative to the potential of latent image on the photosensitive plate varies as the paper advances due to the injection of charge from the second roller into the copy paper through the resistance in the rear face of the paper (the charge being determined according to the distance between the second roller and the latent image), so that in spite of the constant gap width, the gap voltage varies, permitting transfer to proceed in the vicinity of $d_3$, in FIG. 5.

During the foregoing second step of transfer operation, the low potential portion $T_L$ of the latent image to be transferred is transferred which image has its high potential portion already transferred. The portion $T_L$ corresponds to the hatched portion of FIG. 7 (R).

Although the gap distance is virtually constant, the second step of transfer is effected due to the variation in the gap voltage while the paper and photosensitive plate are in intimate contact.

Figure 7:
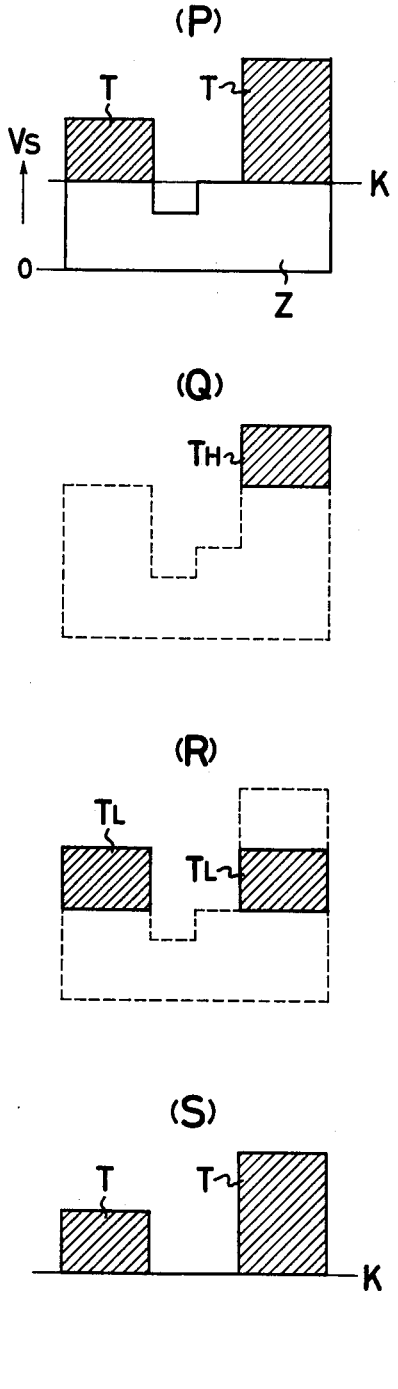
FIGS. 7(P), (Q), (R) and (S) are diagrams showing transferred charge patterns produced by the operation of FIG. 6.

With the charge transferred at the high potential portion $T_H$ by the first roller 28 and at the low potential portion $T_L$ by the second roller 29, the transfer of charge T is completed as shown in FIG. 7 (S).

The transfer under the action of the second roller 29 is completed upon the paper reaching the position immediately above the second roller 29, and the copy paper 25 is then separated from the photosensitive plate 20 (step 3). During the separation, the second roller 29 remains grounded, serving to eliminate the charge induced by the conductive element 27 of the copy paper 25.

In the case where charge transfer is conducted by the approach method, the transfer gap varies over a very wide range depending on the kind, construction and combination of the photosensitive plate and the copy paper. In the case where transfer is conducted by one roller by approach method as illustrated in FIG. 3 in accordance with this invention, the surface potential $V_S$ of the electrostatic latent image in FIG. 5 is 1200 volts with a gap width $d_1$ of 133 microns. With the surface potential of 1000 volts, $d_2$ is 100 microns, with the surface potential of 800 volts, $d_2$ is 50 microns, and with the surface potential of 600 volts, $d_3$ is 19.5 microns.

Accordingly, the space between the dielectric surfaces, namely, the gap width may be reduced to about 20 microns, and it is not necessary to provide a special pressure means for the first or second roller in the case of such gap. Consequently, the apparatus has great freedom with respect to its construction and operation and there is no possibility of the photosensitive plate being defaced by pressure.

In the case where two rollers, i.e. first and second rollers are used for transfer as shown in FIG. 6, the gap width for the initiation of discharge is not more than 100 microns, with $d_3$ set at about 20 microns.

The use of the first roller 28 which is electrically ungrounded or grounded by way of a high resistance element in combination with the directly grounded second roller 29, with the gap width suitably controlled, assures charge transfer within a relatively small range of gap width, although the transfer is effected by the approach method involving air breakdown discharge, hence very high resolution. The transfer is initiated in the vicinity of the first roller 28 and is continuously conducted without interruption until the paper reaches the position above the second roller 29, with effective transfer achieved in the vicinities of portions H and L, the transfer being conducted for the high potential portion $T_H$ during the step 1 and for the low potential portion during the step 2, so that the discharge takes place for a prolonged period of time and abnormal discharge is prevented where the surface potential is high to render the latent image free of damage.

As already described, main factors for adversely affecting the latent image involve the surface potential of the photosensitive plate, the resistance value of copy paper, the resistance of the first roller, etc. Besides these, the distance between the first roller and the second roller, environmental conditions such as temperature, humidity, atmospheric pressure and the like, the angle of contact between the photosensitive plate and copy paper, transfer velocity, etc. may affect the latent image. However, main factors alone will herein be considered with reference to the results of experiments.

The photosensitive plates used for the experiments were laminates each comprising polyvinylcarbazole (PVK) and amorphous selenium (Se) as set forth below:

| | (Thickness) | |
|---|---|---|
| PVK layer | 20 | microns |
| Se layer | 0.6 | microns |
| Aluminum layer | 9 | microns |
| Polyester base layer | 100 | microns |

The resistance value of the second roller (grounded roller) was $6 \times 10^5$ ohms, that of a guide belt (see FIG. 11) was $10^{13}$ ohms and the distance between the first roller and second roller was 70 mm. Transfer velocity was 10 cm/sec.

| | Experiment | | Reference Experiment | |
|---|---|---|---|---|
| | 1 | 2 | 1 | 2 |
| Surface potential of photosensitive plate | 1200 volts | 1500 volts | 1200 volts | 1200 volts |
| Rear face resistance of copy paper | $4 \times 10^7$ ohms | $1 \times 10^{10}$ ohms | $6 \times 10^5$ ohms | $4 \times 10^7$ ohms |
| Front face resistance of copy paper | $2 \times 10^{13}$ ohms | $5 \times 10^{14}$ ohms | $3 \times 10^{11}$ ohms | $2 \times 10^{13}$ ohms |
| Volume resistance of copy paper | $1.5 \times 10^9$ ohms | $3 \times 10^{12}$ ohms | $2.5 \times 10^7$ ohms | $1.5 \times 10^9$ ohms |
| Resistance of first roller | $10^{13}$ ohms | $10^{13}$ ohms | $10^{13}$ ohms | $10^5$ ohms |
| Latent image | No damage | No damage | Damaged | Damaged |

The surface potential of the photosensitive plate was higher in Experiment 2 than in Experiment 1. It was found that if the copy paper had a high resistance value the resulting latent image was free of damage (i.e. free of non-developed spots in dark portion of developed image).

The surface potential of the photosensitive plate in Reference Example 1 was at the same level as in Experiment 1. The latent image was found damaged if the copy paper was low in resistance. Reference Experiment 2 was identical to Experiment 1 with respect to the surface potential of the photosensitive plate and the resistance of copy paper, but the low resistance of the first roller resulted in damage to the latent image.

In view of the fact that the use of the second grounded roller alone without employing the first transfer roller (high resistance roller) does not cause damage to the latent image if the surface potential of the photosensitive plate is approximately below 800 volts, it is considered that in Experiments 1 and 2 of the provision of the first roller reduced the gap voltage to about 800 volts.

According to U.S. Pat. No. 3,240,596 of H. C. Medley, et al. and the aforementioned U.S. Pat. No. 3,147,679, the surface of copy paper is electrostatically charged to a potential of polarity opposite to the polarity of charge of the latent image on the photosensitive plate before the copy paper is brought into intimate contact with the photosensitive plate. In the present invention, however, such previous charging of copy paper is of no sense, but rather gives rise to objections such as reduction in the density of the developed image.

Figure 8:
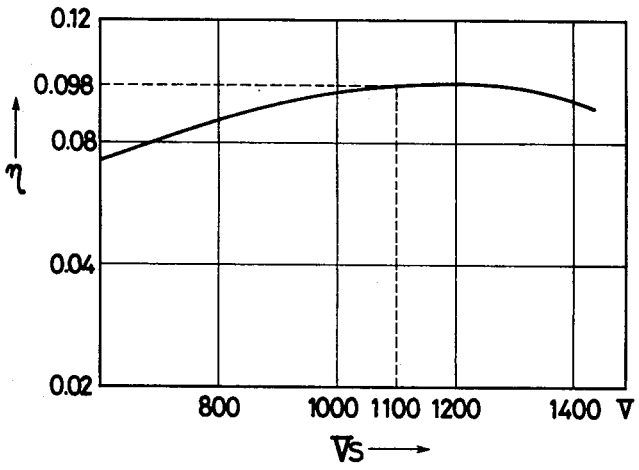
FIG. 8 is a graph showing transfer efficiency as determined by the relation between the surface potential of photosensitive plate and the surface potential of transfer paper, the graph being plotted based on actually measured values.

FIG. 8 is a graph showing the relationship of $\eta = V_T/V_S$ in which $V_S$ is the surface potential of photosensitive plate and $V_T$ is the surface potential of copy paper, the graph being plotted based on actually measured values. When transfer is conducted by the usual method in which copy paper, not previously charged, is brought into intimate contact with a photosensitive plate charged to $-1100$ volts, the surface potential of the copy paper will be: $V_T = V_S \times \eta = -1100$ volts $\times$ $0.098 = -108$ volts. Thus as shown in FIG. 9 (A), electrostatic contrast is 108 volts (which is in this case an effective electrostatic contrast relative to the ground potential).

Likewise, a photosensitive plate is charged to $-1100$ volts, and the surface of copy paper is previously charged to a potential of $+40$ volts of polarity opposite to the charge on the plate. The copy paper (electrostatic capacity: 650 PF/cm$^2$) is brought into intimate contact with the photosensitive plate (electrostatic capacity: 130 PF/cm$^2$), this giving a gap voltage of $-1300$ volts ($1100 - (40 \times 650/130) = -1300$ volts). Because $\eta = 0.098$ in FIG. 8, $$V_T = -1300 \text{ volts} \times 0.098 = -127 \text{ volts}$$

Accordingly, the charge of $-127$ volts is to be transferred to the copy paper. However, since the copy paper is previously charged to $+40$ volts, actual transferred potential will be $-127 + 40$ volts $= -87$ volts.

Figure 9:
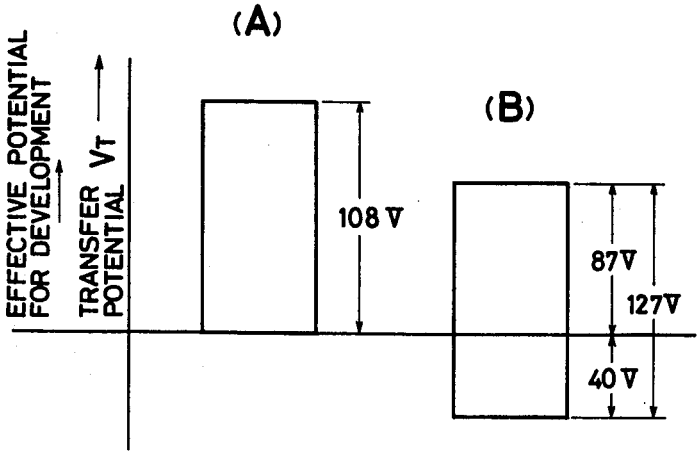
FIGS. 9 (A) and (B) are diagrams showing transfer potential and effective electrostatic contrast produced when copy paper has not been precharged and when copy paper has been precharged.

Although the resulting electrostatic contrast as shown in FIG. 9 (B) is greater than in the case of FIG. 9 (A), the effective electrostatic contrast in view of the ground potential is 87 volts, which is lower than 108 volts in the case of (A) in which previous charge is not given. Thus the charge previously given to the copy paper reduces the contrast of the developed image.

Experiments were conducted under the conditions of:

A: previous charge $V_{MT} = \mathbf{O}$, and surface potential of photosensitive plate $V_S = -1100$ volts.

B: previous charge $V_{MT} = +40$ volts, and surface potential of photosensitive plate $V_S = -1200$ volts.

Further the application to the copy paper of a previous charge of a polarity opposite to the polarity of charge on the photosensitive plate increases the gap voltage and damages the latent image in spite of reduction in the density of the image. Thus the pre-charging of copy paper gives no benefit to this invention.

Figure 10:
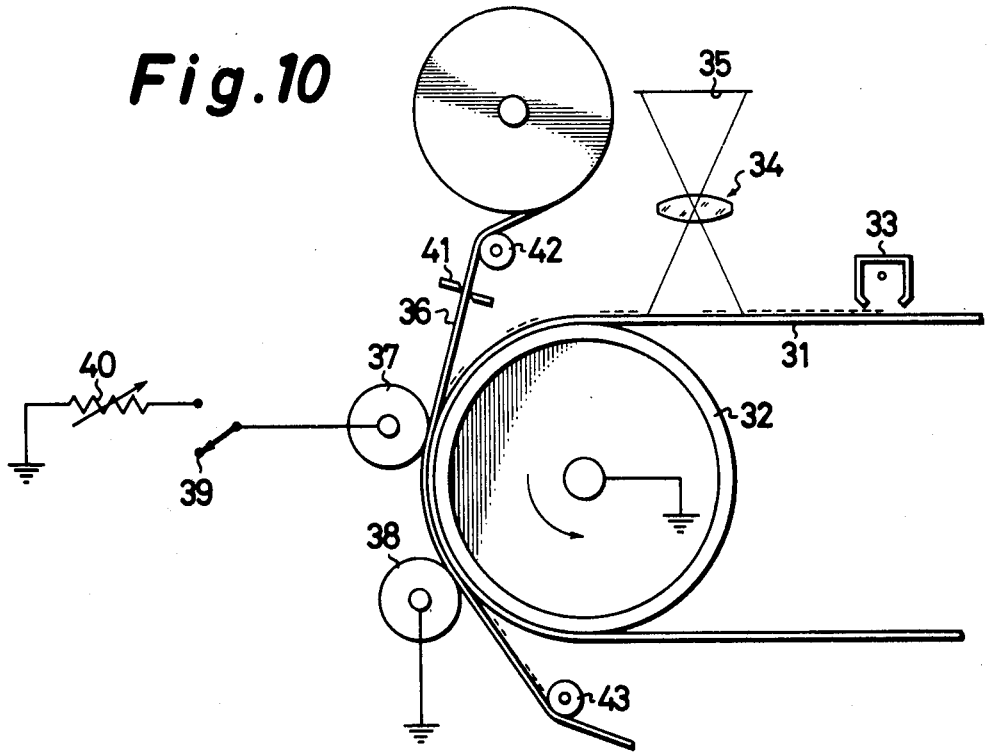
FIG. 10 is a diagram showing a mode of practicing the present invention, the diagram showing only the principal part thereof.

FIG. 10 shows the construction of principal part of an embodiment ofthis invention, in which a photosensitive plate 31 in the form of a belt is reeved around a roller 32 and another roller (not shown) and is driven in the direction of the arrow shown. An electrically conductive support for the plate 31 is grounded. A charger 33 disposed in the path of advance of the photosensitive plate 31 charges the surface of the plate 31 for instance negatively (or positively). An exposure optical system represented by a lens 34 projects the image of an original 35 onto the surface of the photosensitive plate 31 to form an electrostatic latent image thereon.

Copy paper 36 is paid out from its roll portion and led to the surface of the photosensitive plate 31 by the first roller 37 for the initiation of charge transfer already described. Until the paper reaches the position of the second roller 38, it is kept in contact with the photosensitive plate 31 with the aforesaid gap interposed therebetween for sustained charge transfer, namely for discharge and is separated from the photosensitive plate 31 at the position of the second roller 38.

If the first roller 37 is made of an electrically conductive material, the roller is electrically ungrounded as indicated at 39 or is grounded by way of a high resistance element 40 so as to prevent abnormal discharge when the copy paper 36 is brought close to the photosensitive plate 31 with a relatively large gap interposed therebetween. The high resistance element 49 may conveniently be a variable resistor as already described.

If the roller 37 is made of an insulating material having a high electric resistance, the result achieved will be the same as when the roller is connected to a high resistance element. The shaft of the roller 37 may then be directly grounded or electrically ungrounded.

The second roller 38 is electrically conductive and is grounded directly as already described. When paid out a specified length, the copy paper 36 is cut off by a cutter 41 operated by known or some other suitable means (not shown). Guide rollers 42 and 43 are provided for the copy paper 36.

Figure 11:
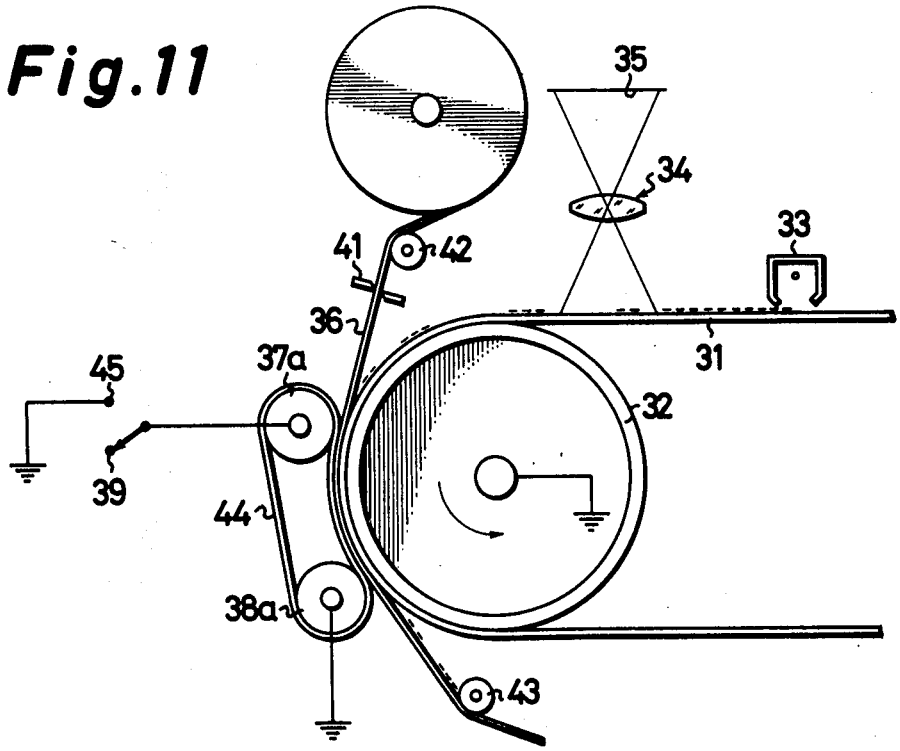
FIG. 11 is a diagram corresponding to FIG. 10 and showing another mode of practicing the present invention.

The variable resistor 40 shown in FIG. 10 may be replaced by a belt 44 reeved around a first roller **37*a* and a second roller 38*a* as shown in FIG. 11, and supporting the rear face of the copy paper 36, the belt 44 having a resistance value (not lower than $10^5$ ohms) approximately at least as high as that of the electricallyconductive lining element in the rear face of the copy paper 36. If the first roller 37*a* is a conductive roller such as a metal roller, the roller may be electrically ungrounded or grounded by way of a high resistance element. If it is a highly insulating roller made for example of synthetic resin, the roller shaft may be grounded by way of a contact 45. The second roller 38*a* is electrically conductive and is grounded. The belt 44 serves as a guide by which the leader end of the copy paper 36 that has passed over the first roller 37*a* is sent to the second roller 38*a*. The belt 44 further serves to keep the gap between the photosensitive plate 31 and the copy paper 36** to a range required for charge transfer.

In the construction described, the roll of copy paper used for the transfer of latent images has its transfer face positioned externally of the roll, so that it has a rolling up tendency such that upon completion of the charge transfer the paper tends to separate from the photosensitive plate. Consequently, in the case where the first and second rollers are used, the leader end of the paper which has passed over the first roller tends to separate from the photosensitive plate due to its own rolling up property and body or stiffness, or is liable to be folded or deviated.

Figure 12:
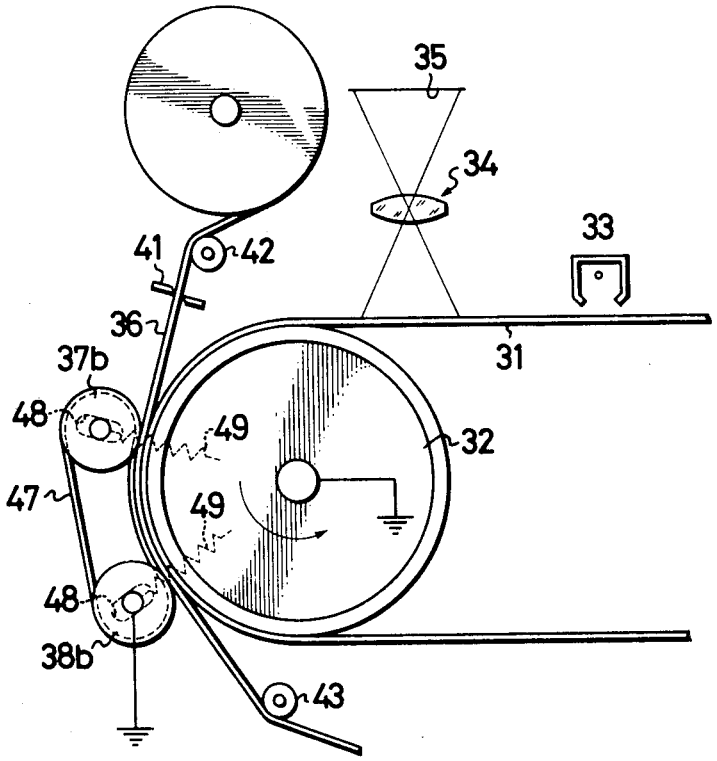
FIG. 12 is a diagram corresponding to FIG. 10 and showing another mode of practicing the present invention.
Figure 13:
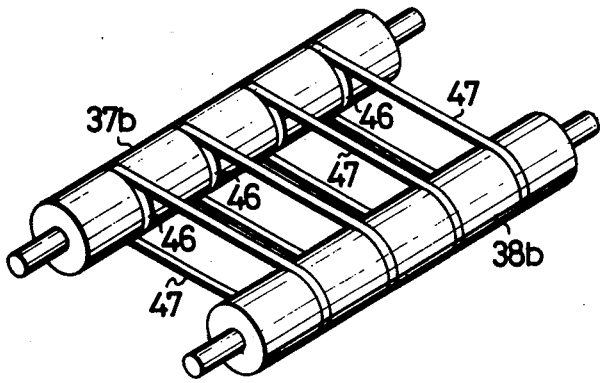
FIG. 13 is a perspective view showing guide means of FIG. 12.

The belt already described serves to eliminate such objections. FIGS. 12 and 13 show other embodiments of the guide means. A first roller **37*b* is made of a highly resistant or insulating material having a high electric resistance value higher than the resistance value of the conductive lining element of the copy paper 36, in other words, than the rear face resistance of the copy paper 36. The second roller 38*b* is made of material having an electric resistance value lower than the rear face resistance of the copy paper 36. Each of the rollers 37*b* and 38*b* is formed with a suitable number of grooves 46, and narrow belts 47 fit in the grooves and extend around the rollers 37*b* and 38*b*. The outer peripheries of the belts 47 are tangentially flush with the outer peripheries of the rollers 37*b* and 38*b*. If the second roller 38*b* is made of a very elastic material such as an electrically conductive sponge, the roller may be smooth surfaced in the form of a cylinder without forming the grooves 46** therein.

Generally in the case where such guide means is provided, the electric resistance value thereof and the width of the narrow belts 47 serving as guide members affect the charge transfer.

It is noted that the threadlike belts 47 are reeved around the insulator or highly resistant first roller **37*b*, and the electrically conductive second roller 38*b*. If the belts 47 are electrically conductive, transfer promoting charges will be applied from the ground roller 38*b* to the first roller 37*b* through the belts, making it insignificant to render the first roller 37*b* insulating. Accordingly, it is preferable that the belts 47 be made of a material having a resistance of at least $10^5$ ohms which is higher than the rear face resistance of the copy paper 36**.

It is further desired that the belt 47 have a small width of not greater than 5 mm (0.2 inch), because the insulating belts 47 extending around the conductive roller **38*b* will act as insulating portions partially formed in the roller to result in non-uniform charge transfer, notwithstanding that the insulating second roller 38 must act to inject transfer promoting charges into the copy paper through grounding. If the narrow belts 47** have a width of not greater than 5 mm, charges can be applied uniformly to the paper through the conductive layer on its back.

The belts 47 further come into contact with the surface of the photosensitive plate 31. Care must be taken not to deface the photosensitive plate. It is therefore preferable that the belts be softer and more flexible than the photosensitive layer. For dimensional adjustment, the belts may further advantageously have elasticity.

Where the belts 47 are in contact with the first and second rollers **37*b* and 38*b*, it is desired to position them flush with the rollers 37*b* and 38*b* tangentially. If the belts 47 should project from the surface of the roller 37*b* or 38*b***, non-uniform charge transfer would result or the paper would crease.

The copy paper 36 led onto the first roller **37*b* is guided by the narrow belts 47 to the second roller 38*b* without being folded at its leader end or being separated from the surface of the photosensitive plate 31, with a constant gap maintained between the paper and the photosensitive plate 31** as required for the transfer.

FIG. 12 shows how the first and second rollers **37*b* and 38*b* are supported. Unillustrated side plates are formed with slots 48 for receiving the opposite ends of the shafts of the rollers 37*b* and 38*b*. Springs 49 are connected to the ends of the shafts to urge the first and second rollers 37*b* and 38*b* toward the photosensitive plate 31. The springs have such strength that the spring loaded rollers 37*b* and 38*b* will maintain between the copy paper 36 and the photosensitive plate 31 a gap of the order of 20 microns as required in this invention. There is no need to strongly press the paper 36 against the photosensitive plate 31**.

Figure 14:
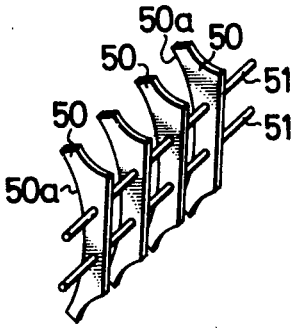
FIG. 14 is a perspective view showing another embodiment of the guide means.

FIG. 14 shows another embodiment of the guide means described. The guide means to be interposed between the first roller 37 and the second roller 38 comprises a suitable amount of guide blades 50 connected together by stays 51 and having guide edges **50*a* in a suitable form to pass the copy paper 36 along the surface of the photosensitive plate 31. The assembly is positioned between the rollers 37 and 38 to guide the copy paper. The blades 50** are made of a material having highly insulating properties or a higher resistance value than the rear face resistance of the transfer paper, permitting no injection of charges into the paper.

Figure 15:
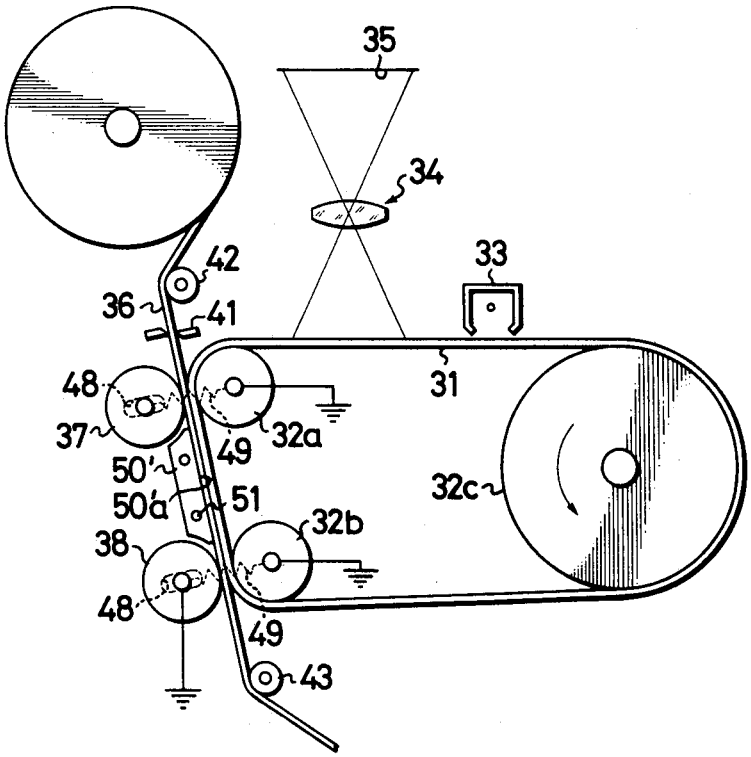
FIG. 15 is a diagram corresponding to FIG. 10 and showing another mode of practicing this invention.

FIG. 15 shows another embodiment of the present invention in which the belt shaped photosensitive plate 31 is supported on and driven by three electrically conductive, grounded rollers 32*a*, 32*b* and 32*c*, the plate being maintained in a planar form at the transfer station by the rollers 32*a* and 32*b*. Accordingly, the guide blades 50' have straight guide edges 50*a'* and are disposed between the first roller 37 and the second roller 38 to support the rear face of the copy paper 36.

As in the embodiment of FIG. 12, the first and second rollers 37 and 38 are supported by the combination of slots 48 and springs 49. The first roller 37 is made of a material having high insulating properties or electrical conductivity. If it is a conductive roller, it may be electrically ungrounded or grounded by way of a high resistance element. The second roller 38 is an electrically conductive grounded roller.

Figure 16:
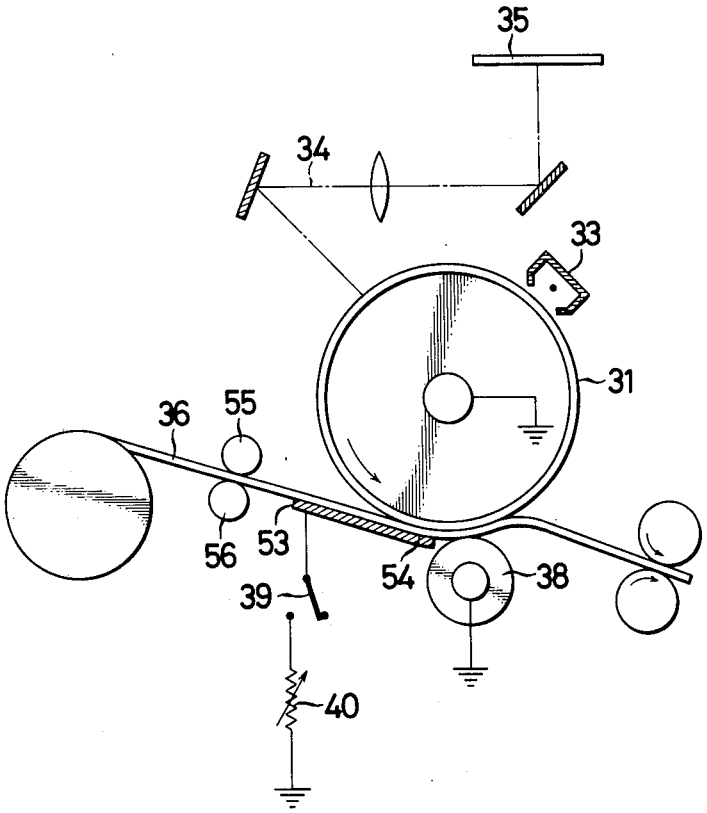
FIg. 16 is a diagram showing another mode of practicing the present invention, the diagram showing only the principal parts thereof.

In FIG. 16 there is shown another embodiment of the present invention, in which the place of the first roller in the foregoing embodiment a guide member consisting of a sheet or a plurality of arranged blades is provided with the remaining mechanism unchanged.

Figure 17:
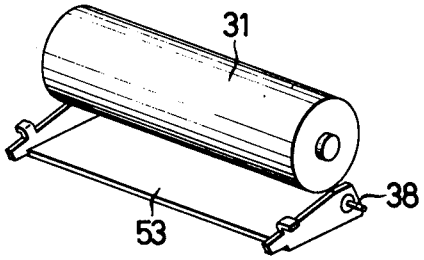
FIG. 17 is a perspective view corresponding to FIG. 16 showing the guide member employed therein.

To be specific, the numeral 53 in FIG. 16 represents a guide member replacing the first roller, which guide member as shown in FIG. 17 is in the form of a sheet extending axially parallel with the drum shaped photosensitive plate 31. The guide member 53 is disposed substantially parallel with the direction of movement of the copy paper and its one or leading edge 54 is in substantial contact with the surface of the photosensitive plate 31. "Substantial contact" as employed herein means that the air gap already described is maintained between the copy paper and the latent image when the paper advances or passes.

As with the first roller, the guide member 53 is electrically floating, namely, connected to the contact 39 or is earthed through the high resistance element 40. That is, when made of a conductive material such as metal foil, the guide plate 53 is electrically floated by the contact 39 or earthed or grounded through the high resistance element 40 set to a resistance higher than that of the conductive layer of the copy paper, so as to prevent abnormal discharge when the air gap is relatively wide before the copy paper 36 approaches the photosensitive plate 31. On the other hand, when made of a high resistance insulating material such as Mylar (trademark) and polyurethane, the guide member 53 may be directly earthed or electrically floating. Coming into substantial contact with the photosensitive plate surface 31, the guide member 53 is preferably an elastic or resilient body. The foregoing Mylar, polyurethane, metal foil, etc. meet these requirements. Also, the guide member 53 may preferably be in the form of a sheet or blades as shown in FIG. 14. But when it is difficult to form the guide member 53 into such shape because, for example, of a weak material, a proper support may be used to cover the guide member 53.

The last described apparatus, like that first described, has its photosensitive plate surface 31 uniformly charged by the charger 33 and an electrostatic latent image of the original 35 is then formed on the surface 31 by the known optical system 34.

Thereafter, the copy paper 36 is withdrawn from the copy paper roll and guided onto the guide member 53 through the transport rollers 55, 56. The conductive layer of the copy paper 36 approaches the photosensitive surface 31 while supported by the guide member 53. Since one edge of the guide member 53 is in contact with the photosensitive surface 31, the copy paper 36 comes into substantial contact with the surface 31. The guide member 53 is electrically floated or earthed through the high resistance element 40, and so only the transfer of the high potential portion of an electrostatic latent image is accelerated, as in the case of the first roller, and then that of the low potential portion is effected by the earthed or grounded second roller 38. Thus, the transfer of a high resolution latent image is obtained.

In the second embodiment of the present invention, the transfer of the high potential portion of a latent image is achieved by the guide member 53 in the form, for example, of a sheet. This makes it possible to provide the guide member 53 adjacent or in close proximity to the second roller 38. Thus, the present apparatus has the advantage that the foregoing copy paper transfer is started after the paper comes into close contact with the photosensitive surface 31 and continued while the paper is in contact with the surface 31 within the range of the preceding air gap until the paper reaches the second roller 38. This prevents damage to an image resulting from the rear or trailing end of the copy paper deviating from the photosensitive surface 31, which deviation is liable to occur after the rear end of paper passes the guide member 53.

As is clear from the foregoing, the guide member 53 described above taking the place of the first roller in the first embodiment achieves the same effective transfer of an electrostatic latent image as the first roller.

Although the foregoing embodiments include the photosensitive plate in the form of a belt, the photosensitive plate may be fixed to the peripheral surface of a grounded roller or cylinder to use the same in a drum shape.

We claim:

1. A process of transferring an electrostatic latent image for electrophotography comprising the steps of:

a. forming the electrostatic latent image on a dielectric layer on the front face of a photoconductive plate having on its rear face an electrically conductive layer substantially grounded while the photoconductive plate is being driven by a drive member;

b. bringing copy paper onto the latent image bearing surface of the photoconductive plate by a first member to advance the copy paper with a small air gap maintained between the paper and the plate, the copy paper having on its rear face an electrically conductive lining layer having a high electric resistance of $10^5$ to $10^{10}$ ohms and on its front face a dielectric layer, the first member serving substantially as a high resistance element having a higher electric resistance than the conductive lining layer, the transfer of the high potential portion of the latent image to the copy paper being initiated as the copy paper advances between the plate and the first member and being limited by the resistance of the first member;

c. injecting a transfer charge into the copy paper travelling along the photoconductive plate with a small air gap maintained therebetween by a second member grounded and having a lower electric resistance than the conductive lining layer of the copy paper, the low potential portion of the latent image being transferred to the copy paper as it traverses the second member whereas the copy paper is spaced from the latent image surface by the small air gap of at least 10 microns; and d. separating the copy paper from the photoconductive plate after the paper has passed over the second member.

2. The process as set forth in claim 1 wherein said first member is a roller electrically ungrounded.

3. The process as set forth in claim 1 wherein said first member is a sheet shaped guide member electrically ungrounded.

4. The process as set forth in claim 1 wherein said first member is grounded by way of an electric resistor having a resistance higher than the conductive lining layer of the copy paper.

5. The process as set forth in claim 3 wherein said first member is disposed transversely to the surface of the photoconductive plate with one end area of the member in substantial contact with the plate.

6. The process of claim 2 including supporting the rear face of the copy paper travelling on the photoconductive plate with the small air gap maintained therebetween to guide the paper by a guide member between the first member and the second member, said guide member being made of a material having a high electric resistance not lower than the resistance of the conductive lining layer of the copy paper.

7. The process of claim 6 wherein the guide member comprises endless belts reeved around the first and second members and having an electric resistance lower than the conductive lining layer of the copy paper.

8. A process of transferring an electrostatic latent image for electrophotography comprising the steps of:

a. forming the electrostatic latent image on a dielectric layer on the front face of a photoconductive plate having on its rear face an electrically conductive layer substantially grounded while the photoconductive plate is being driven by a drive member;

b. bringing copy paper onto the latent image bearing surface of the photoconductive plate by a first member grounded through a high resistance to advance the copy paper with a small gap maintained between the paper and the plate, the copy paper having on its rear face an electrically conductive lining layer having a high electric resistance of $10^5$ to $10^{10}$ ohms and on its front face a dielectric layer, the first member serving substantially as a high resistance element having a higher resistance than the conductive lining layer, the transfer of the high potential portion of the latent image being initiated as the copy paper advances between the plate and the first member and being limited by the resistance of the first member;

c. injecting a transfer charge into the copy paper travelling along the photoconductive plate with a small air gap maintained therebetween by a second member grounded and having a lower electric resistance than the conductive lining layer of the copy paper, the low potential portion of the latent image being transferred to the copy paper as it traverses the second member whereas the copy paper is spaced from the latent image surface by the small air gap of at least 10 microns; and d. separating the copy paper from the photoconductive plate after the plate has passed over the second member.

9. The process as set forth in claim 8 wherein said first member is a roller.

10. The process as set forth in claim 8 wherein said first member is a guide member in the form of a sheet.

* * * * *